US006285840B1

(12) United States Patent
Budnik et al.

(10) Patent No.: US 6,285,840 B1
(45) Date of Patent: Sep. 4, 2001

(54) PRINT QUALITY CONTROL FOR A XEROGRAPHIC PRINTER HAVING AN AC DEVELOPMENT FIELD

(75) Inventors: Roger W. Budnik, Rochester; James M. Pacer, Webster; Scott L. Kauffman; Richard M. Maier, both of Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/669,179

(22) Filed: Sep. 25, 2000

(51) Int. Cl.[7] ..... G03G 15/00; G03G 15/08
(52) U.S. Cl. ..... 399/49; 399/55; 430/120
(58) Field of Search ..... 399/49, 46, 53, 399/55, 270; 430/120; 358/298, 406, 504

(56) References Cited

U.S. PATENT DOCUMENTS

| | | | | |
|---|---|---|---|---|
| 4,610,531 | | 9/1986 | Hayashi et al. | 399/270 |
| 5,390,004 | | 2/1995 | Hopkins | 399/42 |
| 5,402,214 | | 3/1995 | Henderson | 399/58 |
| 5,890,042 | | 3/1999 | Wong et al. | 399/285 |
| 5,937,227 | * | 8/1999 | Wong et al. | 399/49 |
| 6,035,152 | | 3/2000 | Craig et al. | 399/49 |
| 6,198,886 | * | 3/2001 | Brewington | 399/49 |

* cited by examiner

*Primary Examiner*—Sophia S. Chen
(74) *Attorney, Agent, or Firm*—R. Hutter

(57) ABSTRACT

In a xerographic development system wherein toner is conveyed from a donor member to a charge receptor by a development field having a DC bias and an AC component, reflectivities of a first test patch having a first target halftone density and a second test patch having a second target halftone density are measured, resulting in first and second possible errors. If the first error and the second error have the same sign, i.e., both patches are too light or too dark, the errors are substantially cured by altering the DC bias. If the first error and the second error have different signs, i.e. one patch is too dark and the other too light, a different correction strategy is employed.

8 Claims, 4 Drawing Sheets

PRINT QUALITY CONTROL FOR A XEROGRAPHIC PRINTER HAVING AN AC DEVELOPMENT FIELD

FIELD OF THE INVENTION

This invention relates generally to a development system as used in xerography, and more particularly concerns a "jumping" development system in which toner is conveyed to an electrostatic latent image by an AC field.

BACKGROUND OF THE INVENTION

In a typical electrostatographic printing process, such as xerography, a photoreceptor is charged to a substantially uniform potential so as to sensitize the surface thereof. The charged portion of the photoreceptor is exposed to a light image of an original document being reproduced. Exposure of the charged photoreceptor selectively dissipates the charges thereon in the irradiated areas. This records an electrostatic latent image on the photoreceptor corresponding to the informational areas contained within the original document. After the electrostatic latent image is recorded on the photoreceptor, the latent image is developed by bringing a developer material into contact therewith. Generally, the developer material comprises toner particles adhering triboelectrically to carrier granules. The toner particles are attracted from the carrier granules to the latent image forming a toner powder image on the photoreceptor. The toner powder image is then transferred from the photoreceptor to a copy sheet. The toner particles are heated to permanently affix the powder image to the copy sheet. After each transfer process, the toner remaining on the photoconductor is cleaned by a cleaning device.

One specific type of development apparatus currently used in high-quality xerography is known as a hybrid jumping development (HJD) system. In the HJD system, a layer of toner is laid down evenly on the surface of a "donor roll" which is disposed near the surface of the photoreceptor. Biases placed on the donor roll create two development fields, or potentials, across the gap between the donor roll and the photoreceptor. The action of these fields causes toner particles on the donor roll surface to form a "toner cloud" in the gap, and the toner in this cloud thus becomes available to attach to appropriately-charged image areas on the photoreceptor.

The present invention is a control system for print quality for such a hybrid jumping development system, the control system having as inputs measured reflectivities of test patches of predetermined target halftone densities, such as a 50% halftone screen and an 87.5% halftone screen, and having as outputs changes in the DC bias and AC amplitude of the development field, as well as the initial charging voltage on the photoreceptor and the power associated with an imaging device, such as a laser, which creates the image on the photoreceptor.

DESCRIPTION OF THE PRIOR ART

U.S. Pat. No. 4,610,531 discloses the basic concept of jumping development with an AC field set up between a donor member and a photoreceptor.

U.S. Pat. No. 5,390,004 discloses a control system for a xerographic printing system in which the reflectivity of a set of test patches is measured, and the reflectivities are fed into a fuzzy-logic control system for the xerographic parameters.

U.S. Pat. No. 5,402,214 discloses a control system for a xerographic printing system in which the reflectivity of a test patch is measured, and the DC bias of a field associated with the development unit is adjusted accordingly. When the DC bias is caused to exceed a predetermined maximum, fresh developer is added to the primary developer supply.

U.S. Pat. No. 5,890,042 discloses a hybrid jumping development system, in which a donor roll is loaded with a layer of toner particles by a magnetic roll which conveys toner which adheres to carrier granules.

U.S. Pat. No. 6,035,152 discloses a control system for a xerographic printing system in which the reflectivity of a set of test patches is measured, and the reflectivities are fed into a control system for the xerographic parameters.

SUMMARY OF THE INVENTION

In accordance with one aspect of the present invention, there is provided, in an electrostatographic development system wherein toner is conveyed from a donor member over a development gap to a charge receptor by an AC development field in the development gap, a method comprising the following steps. Actual reflectivities are measured of a first test patch having a first target halftone density, and a second test patch having a second target halftone density, thereby determining a first error and a second error respectively. If the first error and the second error have the same sign, there is determined a first change in DC bias which will substantially cure the first error and a second change in DC bias which will substantially cure the second error. The DC bias is then altered according to the smaller of the first change in DC bias and second change in DC bias.

In accordance with another aspect of the present invention, there is provided, in an electrostatographic development system wherein toner is conveyed from a donor member over a development gap to a charge receptor by an AC development field in the development gap, a method comprising the following steps. Actual reflectivities are measured of a first test patch having a first target halftone density, and a second test patch having a second target halftone density, thereby determining a first error and a second error respectively. If the first error and the second error have the same sign, there is determined a first change in DC bias which will substantially cure at least one of the first error and the second error. If the first error and the second error have different signs, there is determined a change in a parameter which will substantially cure at least one of the first error and second error, the parameter being one from a group consisting of DC bias, amplitude of AC component, initial potential on the charge receptor, and power associated with imagewise discharge of the charge receptor.

DETAILED DESCRIPTION OF THE INVENTION

Figure 1:
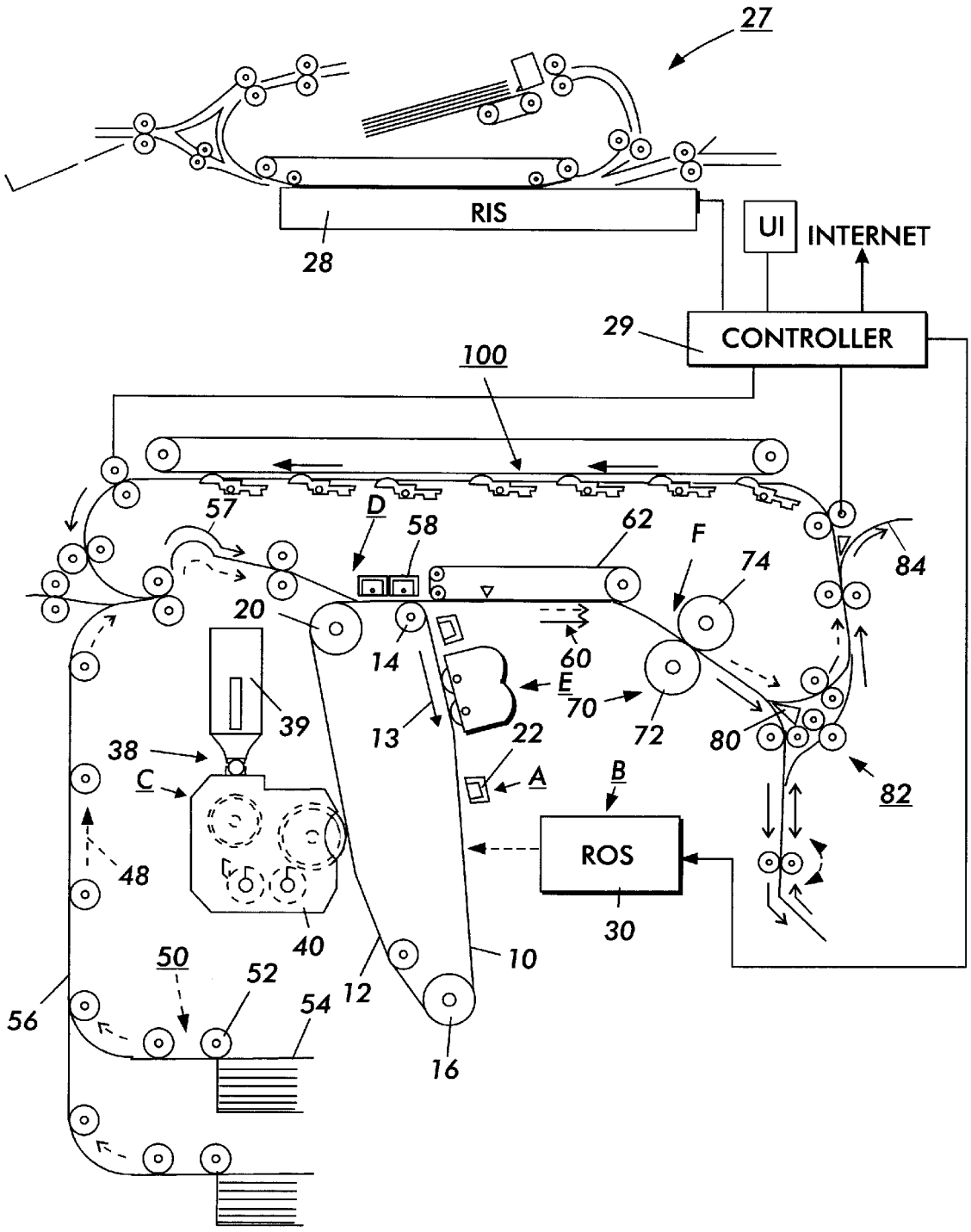
FIG. 1 PRIOR ART
FIG. 1 is a schematic elevational view of a typical electrophotographic printing machine utilizing the toner maintenance system therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the development system of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a photosensor array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoreceptor belt 10. Preferably, the photoreceptor belt 10 is made from a photoconductive material, forming a photoconductive surface 12, coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roll 14, tensioning roll 16 and drive roll 20. As roll 20 rotates, it advances belt 10 in the direction of arrow 13.

Initially, a portion of the photoconductive surface passes through charging station A. At charging station A, a corona generating device indicated generally by the reference numeral 22 charges the photoreceptor 10 to a relatively high, substantially uniform potential.

At an exposure station B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoreceptor 10 to record an electrostatic latent image thereon corresponding to the continuous tone image received from ESS 29. As an alternative, ROS 30 may employ a linear array of light emitting diodes (LEDs) arranged to illuminate the charged portion of photoreceptor 10 on a raster-by-raster basis.

After the electrostatic latent image has been recorded on photoconductive surface 12, photoreceptor 10 advances the latent image to a development station, C, where toner, in the form of liquid or dry particles, is electrostatically attracted to the latent image using the device of the present invention as further described below. The latent image attracts toner particles from the carrier granules forming a toner powder image thereon. As successive electrostatic latent images are developed, toner particles are depleted from the developer material. A toner particle dispenser, indicated generally by the reference numeral 39, on signal from controller 29, dispenses toner particles into developer housing 40 of developer unit 38 based on signals from a toner maintenance sensor (not shown).

With continued reference to FIG. 1, after the electrostatic latent image is developed, the toner powder image present on photoreceptor 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roll 72 and a pressure roll 74 with the powder image on the copy sheet contacting fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed for recirculation back through transfer station D and fuser 70 for receiving and permanently fixing the side two image to the backside of that duplex sheet, before it exits via exit path 84.

After the print sheet is separated from photoconductive surface 12 of photoreceptor 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The control of all of the exemplary systems heretofore described may be accomplished by conventional control switch inputs from the printing machine consoles selected by the operator.

Figure 2:
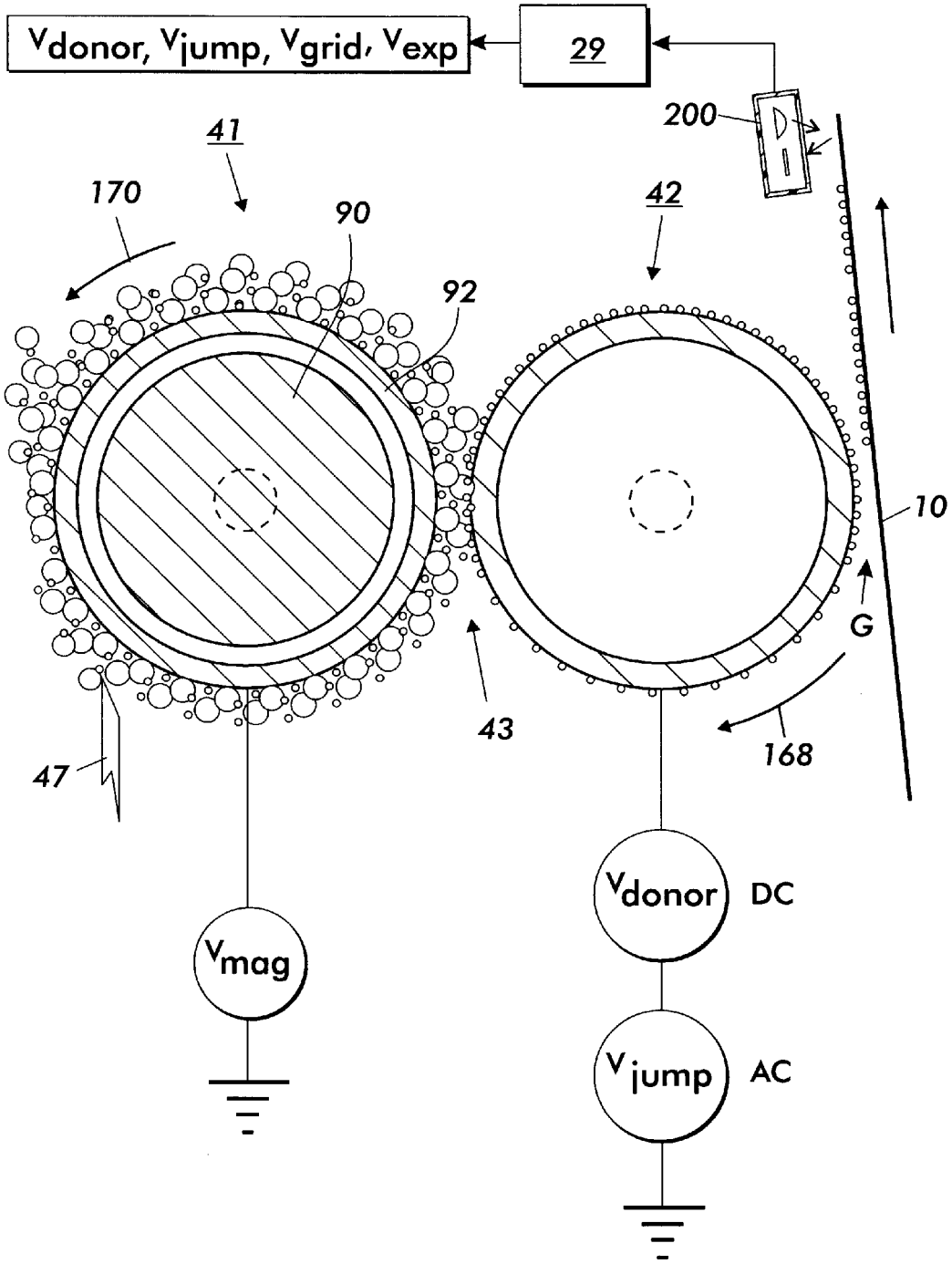
FIG. 2 is a schematic elevational view of the development system utilizing the invention herein.

Turning now to FIG. 2, there is shown development system 38 in greater detail. More specifically, a hybrid development system is shown where toner is loaded onto a donor roll from a second roll, e.g. a magnetic brush roll. The toner is developed onto the photoreceptor from the donor roll using the hybrid jumping development system (HJD) described below. As shown thereat, development system 38 includes a housing 40 defining a chamber for storing a supply of developer material therein. Donor roll 42 and magnetic roll 41 are mounted in chamber of housing 40. The donor roll 42 can be rotated in either the 'with' or 'against' direction relative to the direction of motion of the photoreceptor 10.

In FIG. 2, donor roll 42 is shown rotating in the direction of arrow 168, i.e. the against direction. Similarly, the magnetic roll 41 can be rotated in either the 'with' or 'against' direction relative to the direction of motion of donor roll 42. In FIG. 2, magnetic roll 41 is shown rotating in the direction of arrow 170 i.e. the with direction. Donor roll 42 is preferably made from a conductive core which may be a metallic material with a semi-conductive coating such as a phenolic resin or ceramic.

Magnetic roll 41 meters a constant quantity of toner having a substantially constant charge onto donor roll 42. This ensures that the donor roll provides a constant amount of toner having a substantially constant charge as maintained by the present invention in the development gap. Metering blade 47 is positioned closely adjacent to magnetic roll 41 to maintain the compressed pile height of the developer material on magnetic roll 41 at the desired level. Magnetic roll 41 includes a non-magnetic tubular member 92 made preferably from aluminum and having the exterior circumferential surface thereof roughened. An elongated magnet 90 is positioned interiorly of and spaced from the tubular member. The magnet is mounted stationarily. The tubular member rotates in the direction of arrow 170 to advance the developer material adhering thereto into the nip 43 defined by donor roll 42 and magnetic roll 41. Toner particles are attracted from the carrier granules on the magnetic roll to the donor roll.

Further as shown in FIG. 2, the magnetic roll 41 and the donor roll 42 are respectively biased in order to convey toner particles from a magnetic roll 41 to donor roll 42, and then across the gap, indicated as G, between of the donor roll 42 and is the surface of photoreceptor 10. With regard to magnetic roll 41, the bias on the roll is indicated as Vmag, which is a simple DC bias. Donor roll 42 is, in turn, biased with both a DC bias, indicated as Vdonor, and a superimposed AC bias, indicated as Vjump. (The photoreceptor 10 is typically connected to ground, such as through a backer bar, not shown, in contact therewith.) The AC on the donor roll 42 ultimately causes the toner layer on the donor roll 42 to form a "cloud" of toner near the gap between the donor roll 42 and the photoreceptor 10: in this way, the free toner particles in the cloud can attach to appropriately-charged image areas on the photoreceptor 10.

Figure 3:
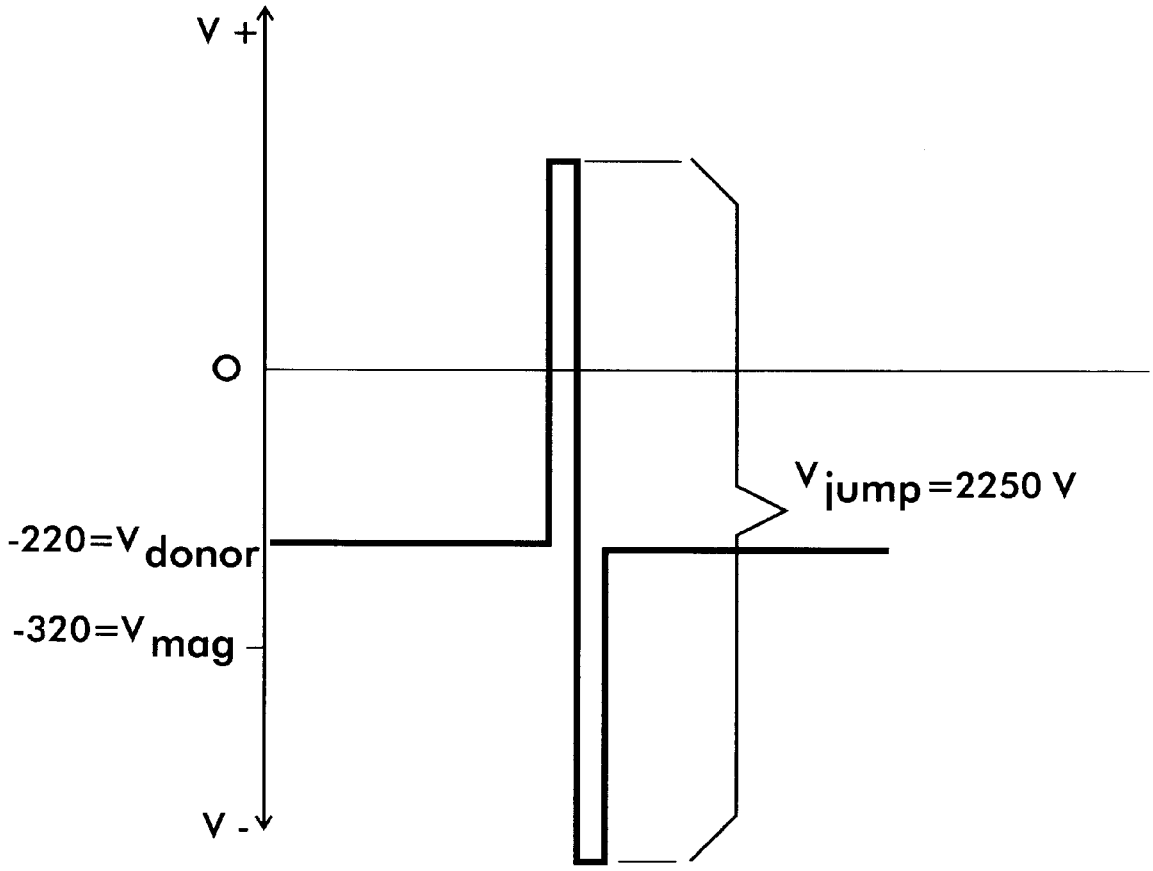
FIG. 3 is a diagram showing the biases of various elements in a development system.

FIG. 3 is a diagram showing the relative biases on magnetic roll 41 and donor roll 42 for a typical practical embodiment of a xerographic printer. This practical embodiment will further be discussed with specific reference to the claimed invention, but of course the basic principles shown and claimed herein will apply to any applicable machine design. In this embodiment, for normal operation, the DC bias on the donor roll 42, Vdonor, is −220 VDC. Riding on this DC bias on the donor roll 42 is an AC square wave with an amplitude (top to bottom), Vjump, of 2250V: clearly, a portion of the total bias on donor roll 42 will enter positive polarity, as shown. (A typical frequency of the square wave is about 3.25 kHz.) Magnetic roll 41, under normal conditions, is biased to −113 VDC, shown as Vmag.

The present invention is a control system for print quality for such a hybrid jumping development system, the control system having as inputs measured reflectivities of test patches of predetermined target halftone densities, such as a 50% halftone screen and an 87.5% halftone screen, and having as outputs changes in the DC bias and AC amplitude of the development field, as well as the initial charging voltage on the photoreceptor and the power associated with an imaging device, such as a laser, which creates the image on the photoreceptor 10.

Figure 4:
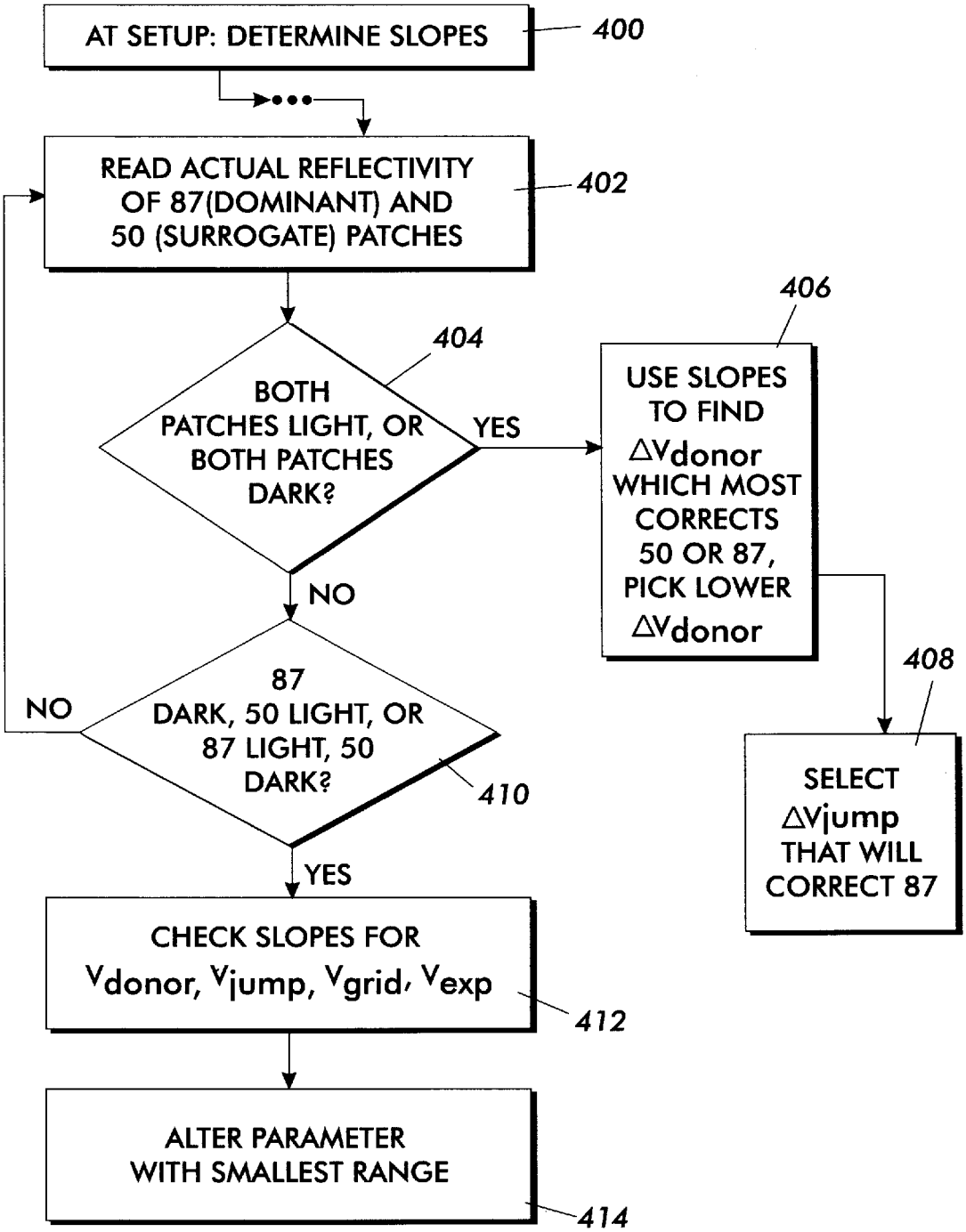
FIG. 4 is an informal flowchart showing the basic steps of the print quality control system of the present invention.

FIG. 4 is an informal flowchart showing the basic steps of the control method of the present invention. At an initial set up of a particular machine, there is loaded into the memory associated with the control system (step 400) a set of "slopes," meaning mathematical functions showing an empirical relationship between a parameter associated with an actuator and the effect of a change in that parameter on the density of an image developed with the development system being controlled. For purposes of the description herein, an "actuator" is any readily controllable element in the development system: examples of such actuator include, but are not limited to, the initial charging voltage (Vgrid) placed on the photoreceptor 10 by corotron 22; the power associated with a particular laser 30 discharging an image on the photoreceptor 10 (expressible as a voltage Vexp); as well as the DC bias (Vdonor) and AC amplitude (Vjump) on donor roll 42. Other parameters will be apparent in different machine designs within the scope of the claims. The slopes which are reflective of the influence of each parameter on the density of developed images are retained for use by the control system, as will be described in detail below.

When a particular machine is running, at various times (such as at the beginning of each job, or after a certain number of prints are output), the control system causes the machine to create a set of test patches of predetermined target densities on the photoreceptor 10. As can be seen in FIG. 2, these test patches can be read by a densitometer 200 which is disposed downstream of the donor roll 42 along the direction of motion of the photoreceptor 10. As shown at step 402 in FIG. 4, in one practical embodiment of the present invention a preferred target halftone screen of a first type of test patch is 87.5%, and of a second type of test patch is 50% For convenience, for the rest of the present discussion, the first test patch will be called the 87 test patch, and the second test patch will be called the 50 test patch, although more generally one test patch can be called the "dominant patch" and the other called the "surrogate patch." Generally, but not necessarily, the dominant patch is of a target density which is more likely to impact user satisfaction in a given situation, so that if very dark solid areas are mainly desired, such as to print text, the dominant patch should be closer to 100% than the surrogate patch.

Once the actual reflectivities of a given pair of an 87 test patch and a 50 test patch are measured, a certain measured error may be apparent in either or both test patches. One or both of the test patches may be measured as too light or too dark, or one test patch may be too dark and the other test patch may be too light. For purposes of the claims below, when both test patches are dark or light, it can be said that the respective errors are of the same sign, while if one test patch is dark and the other light, then the errors are of different signs.

According to one embodiment of the present invention, the control method performs fundamentally different steps depending on whether the errors associated with the test patches are of the same sign or of different signs. As shown at the step marked 404, if the errors associated with each patch are of the same sign (both too light or both too dark), then the first route toward curing the error (that is, substantially eliminating the error in the future) is to alter Vdonor, the DC bias on donor roll 42. In general, Vdonor probably has the largest gross effect on image density. To determine how much change in Vdonor would be required to cure the problem of too-light or too-dark test patches, reference can be made it to the slopes which were loaded into the machine at step 400. Once again, these slopes express relationships between changes in a parameter, in this case a value of Vdonor, and an empirically determined change in the density of a developed image. For example, according to one slope, a particular measured degree of too-lightness may be cured by a particular increase in Vdonor. How much lightness requires how much increase in Vdonor will, of course, depend on the slope of the empirical relationship.

Further according to the present invention, because in this case there is an error associated with both the 50 and 87 test patch, the mandated change in Vdonor is preferably the smaller of the change in Vdonor which cures either the 50 or 87 test patch error. In other words, when both patches are in error, change Vdonor only to the extent that one error is cured (step 406). As will be seen below, in a preferred embodiment of the present invention, curing the other error may preferably be done by changing another parameter besides Vdonor. As shown at step 408, it is highly possible that the remainder of the error can be cured by selecting a new Vjump which corresponds to the new value of Vdonor, or further consulting a slope describing an empirical relationship between Vjump and the density of the developed image, given a particular value of Vdonor.

With further regard to step 404, in one practical embodiment, the "both errors same sign" condition can be met even if the error associated with one patch is substantially zero, i.e., falls within a predetermined threshold range around zero, regardless of its sign. So, for example, if the 50 test patch is dark and the 87 patch is very slightly too light, this condition can be considered "both patches dark" for purposes of the claimed invention.

Step 410 shows a condition in which both test patches exhibit an error, but the errors are of different signs, that is, one patch is too dark and the other patch is too light. In such a case, merely changing Vdonor may not be sufficient, or even effective, in curing the errors. According to the present invention, if the test patch errors are of different signs, a different correction method is applied than if the test patch errors are of the same sign. In general, with errors of different signs, a number of changes in parameters, affecting a wide range of actuators, are surveyed, and the best change in parameter is selected.

The following is a description of a preferred method for determining which paramter associated with an actuator (Vgrid, Vexp, Vdonor, and Vjump) should be altered, pursuant to steps 412 and 414 in FIG. 4, in the case where the dominant test patch is an 87.5% halftone screen and the surrogate test patch is a 50% halftone screen. In the below description, "rr units" simply mean units of reflectivity of a signal from densitometer 200; the constant values of rr mentioned below are specific to a particular printer design. "MeasuredError" means the error relative to a target reflectivity reading for a given type of test patch; "Actuator" is defined as the change in control level (volts, ergs, etc.) that a device (corotron, laser, donor roll, etc.) would be set to on its power supply; "ActuatorRange" is a relative indication of the total amount of movement (summation of the predicted errors) in the 50 and 87 patches when the particular actuator level is applied. The nature of the other variables are defined in the method.

According to the method, the following steps are repeated for each actuator (in the preferred embodiment, Vgrid, Vexp, Vdonor, and Vjump):

If (50%MeasuredError<4 rr units) then:
87%PredictedError=87%MeasuredError−1.75 rr units
Actuator=87%PredictedError/87%ActuatorSlope
Delta87%Error=87%MeasuredError−87%PredictedError
50%PredictedError=Actuator*50%ActuatorSlope
Delta50%Error=50%MeasuredError−50%PredictedError
ActuatorRange=AbsValue(Delta50%Error)+AbsValue(Delta87%Error).
If (50%MeasuredError>=4 rr units) then: Actuator=87%PredictedError/87%ActuatorSlope
50%PredictedError=Actuator*50%ActuatorSlope
Delta50%Error=50%MeasuredError−50%PredictedError.

In the above steps, as can be seen, a distinction is made between "large" errors in the 50 test patch (more than 4 rr) and "small" errors (less than 4 rr). In attempting to achieve print quality targets which are acceptable to the typical user, the 50 patch has a much greater range of latitude (+/−7 rr) than the 87 patch (+/−4 rr). The control algorithm, at this particular stage in the method, sets even tighter limits on what the errors are desired to be limited to (+/−1 rr for the 50 patch, +/−0.5 rr for the 87 patch). By this stage in the method, it is assumed these tighter ranges cannot be readily met, but that the broader ranges of acceptable quality are achievable. Thus, if the 50 error is <4, the algorithm concentrates on curing the 87 error: it is unlikely that the 87 error can be completely cured to within +/−0.5, thus the subtraction of 1.75 from the 87 error. However, by concentrating the curing steps on the 87 error, it is reasonably likely that the 50 error will be brought into an acceptable range as well.

In the following steps, as can be seen, it is checked whether the predicted change in the 50 error ("Delta50%Error") as calucalted above is large or small (more or less than 4 rr)

If (AbsValue(Delta50%Error)<=4 rr units)
ActuatorRange=AbsValue(Delta50%Error) else
50%PredictedError=50%MeasuredError+4 Actuator=50%PredictedError/50%ActuatorSlope
87%PredictedError=Actuator*87%ActuatorSlope
Delta87%Error=87%MeasuredError−87%PredictedError.
If (AbsValue(Delta87%Error)<=1.75 rr units)
Delta50%Error=4 rr units
ActuatorRange=AbsValue(Delta50%Error)+AbsValue(Delta87%Error) else
87%PredictedError=87%MeasuredError−1.75 rr units
Actuator=87%PredictedError/87%ActuatorSlope
Delta87%Error=87%MeasuredError−87%PredictedError
50%PredictedError=Actuator*50%ActuatorSlope
Delta50%Error=50%MeasuredError−50%PredictedError
ActuatorRange=AbsValue(Delta50%Error)+AbsValue(Delta87%Error)

Once again, "ActuatorRange" is a relative indication of the total amount of movement (summation of the predicted errors) in the 50 and 87 patches when the particular actuator level (i.e., the change in a parameter in an attempt to cure the errors) is applied. According to the present invention, with each correction cycle carried out in response to a reading of test patches, all four controllable parameters (actuators) are considered: Vdonor, Vjump, Vgrid, Vexp. When all four actuators are thus tested and considered, according to the preferred embodiment, the actuator that has the smallest actuator range is chosen, and the particular parameter is adjusted accordingly.

What is claimed is:

1. In a xerographic development system wherein toner is conveyed from a donor member over a development gap to a charge receptor by a development field in the development gap to develop an imagewise-discharged image on the charge receptor, the development field having a DC bias and an AC component having an amplitude associated therewith, a method comprising the steps of:

measuring actual reflectivities of a first test patch having a first target halftone density, thereby determining a first error, and a second test patch having a second target halftone density, thereby determining a second error;

if the first error and the second error have the same sign, determining a first change in DC bias which will substantially cure the first error and a second change in DC bias which will substantially cure the second error; and altering the DC bias according to the smaller of the first change in DC bias and second change in DC bias.

2. The method of claim 1, wherein the step of determining a first DC bias and second DC bias occurs if one of the first error and second error is approximately zero.

3. The method of claim 1, further comprising the step of altering the amplitude of the AC component.

4. The method of claim 1, further comprising the step of if the first error and the second error have different signs, determining a change in a parameter which will substantially cure at least one of the first error and second error, the parameter being one from a group consisting of DC bias, amplitude of AC component, initial potential on the charge receptor, and power associated with imagewise discharge of the charge receptor.

5. The method of claim 4, further comprising the step of altering a selected parameter according to which change in parameter is determined to substantially cure at least one of the first error and the second error.

6. In a xerographic development system wherein toner is conveyed from a donor member over a development gap to a charge receptor by a development field in the development gap to develop an imagewise-discharged image on the charge receptor, the development field having a DC bias and an AC component having an amplitude associated therewith, a method comprising the steps of:

measuring actual reflectivities of a first test patch having a first target halftone density, thereby determining a first error, and a second test patch having a second target halftone density, thereby determining a second error;

if the first error and the second error have the same sign, determining a change in DC bias which will substantially cure at least one of the first error and the second error; and if the first error and the second error have different signs, determining a change in a parameter which will substantially cure at least one of the first error and second error, the parameter being one from a group consisting of DC bias, amplitude of AC component, initial potential on the charge receptor, and power associated with imagewise discharge of the charge receptor.

7. The method of claim 6, wherein the step of determining a change in DC bias if the first error and the second error have the same sign further includes the steps of determining a first change in DC bias which will substantially cure the first error and a second change in DC bias which will substantially cure the second error; and altering the DC bias according to the smaller of the first change in DC bias and second change in DC bias.

8. The method of claim 6, wherein the step of determining a change in DC bias if the first error and the second error have the same sign occurs if one of the first error and second error is approximately zero.

* * * * *